United States Patent [19]

Fanson et al.

[11] 4,366,902

[45] Jan. 4, 1983

[54] SHIPPING SYSTEM FOR AUTOMATIC WASHER

[75] Inventors: Richard L. Fanson, St. Joseph Township, Berrien County; William L. Kennedy, Coloma Township, Berrien County, both of Mich.

[73] Assignee: Whirlpool Corporation, Benton Harbor, Mich.

[21] Appl. No.: 258,931

[22] Filed: Apr. 30, 1981

[51] Int. Cl.[3] ..... B65D 81/06

[52] U.S. Cl. ..... 206/320; 206/523

[58] Field of Search ..... 206/320, 523, 83, 45.16; 68/3 R, 23.3, 23.6, 23.2; 248/665, 666, 667, 668, 669, 670, 671, 672, 673, 674, 675, 676, 677, 678, 679, 680, 681

[56] References Cited

U.S. PATENT DOCUMENTS

| | | | |
|---|---|---|---|
| 1,766,213 | 6/1930 | Bock | 68/23.3 |
| 2,313,928 | 3/1943 | Dyer | 68/23.6 |
| 3,187,887 | 6/1965 | Charles et al. . | |
| 3,249,215 | 5/1966 | Kelly . | |
| 3,321,071 | 5/1967 | Elwell . | |
| 3,335,849 | 8/1967 | Collin . | |
| 3,520,158 | 7/1970 | Takeyama | 68/23.6 |
| 3,620,365 | 11/1971 | Elwell | 206/320 |
| 3,791,692 | 2/1974 | Pierce . | |
| 3,809,232 | 8/1972 | Kennington . | |
| 3,812,959 | 5/1974 | Brennan . | |
| 3,861,525 | 1/1975 | Collin . | |
| 3,896,930 | 7/1975 | Collin . | |
| 3,904,039 | 9/1975 | Anyon . | |
| 3,913,736 | 10/1975 | Brennan . | |
| 3,952,557 | 4/1976 | Bochan | 68/23.3 |

FOREIGN PATENT DOCUMENTS

| | | | |
|---|---|---|---|
| 1324915 | 7/1973 | United Kingdom | 68/23.3 |

*Primary Examiner*—William Price
*Assistant Examiner*—Jimmy G. Foster
*Attorney, Agent, or Firm*—Hill, Van Santen, Steadman, Chiara & Simpson

[57] ABSTRACT

A shipping system for an automatic washer is provided wherein a split block upper shipping brace locks into position as it is installed to secure the upper portion of the basket and a lower shipping brace is attached to the foot holes on the base and connected by a retainer to a boss on the transmission to secure the movable mechanism of the washer against excessive movement during shipping, wherein removal of the shipping means is compelled prior to normal operation.

10 Claims, 11 Drawing Figures

FIG 1
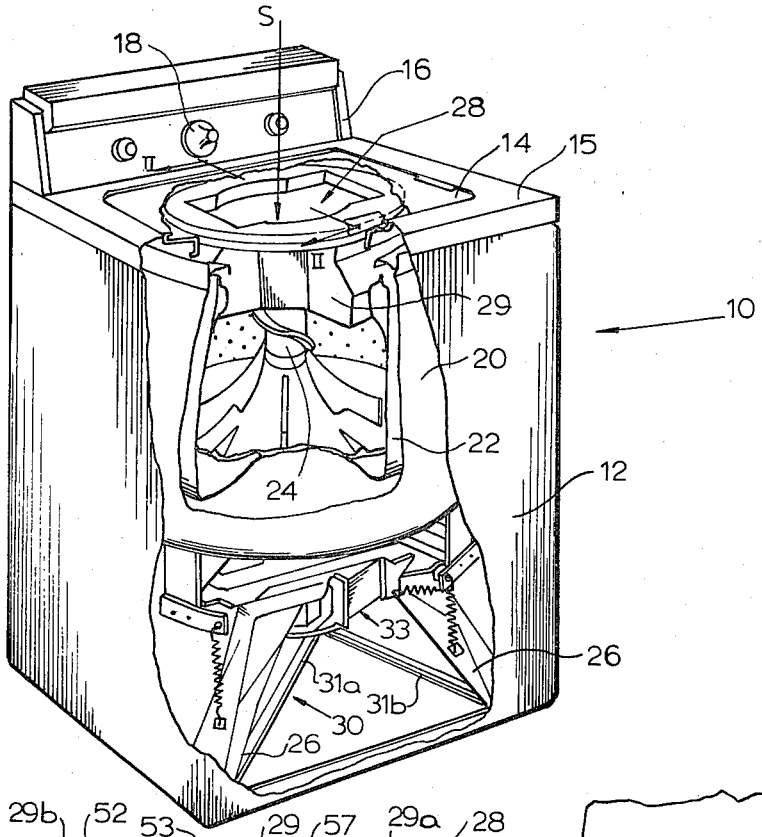
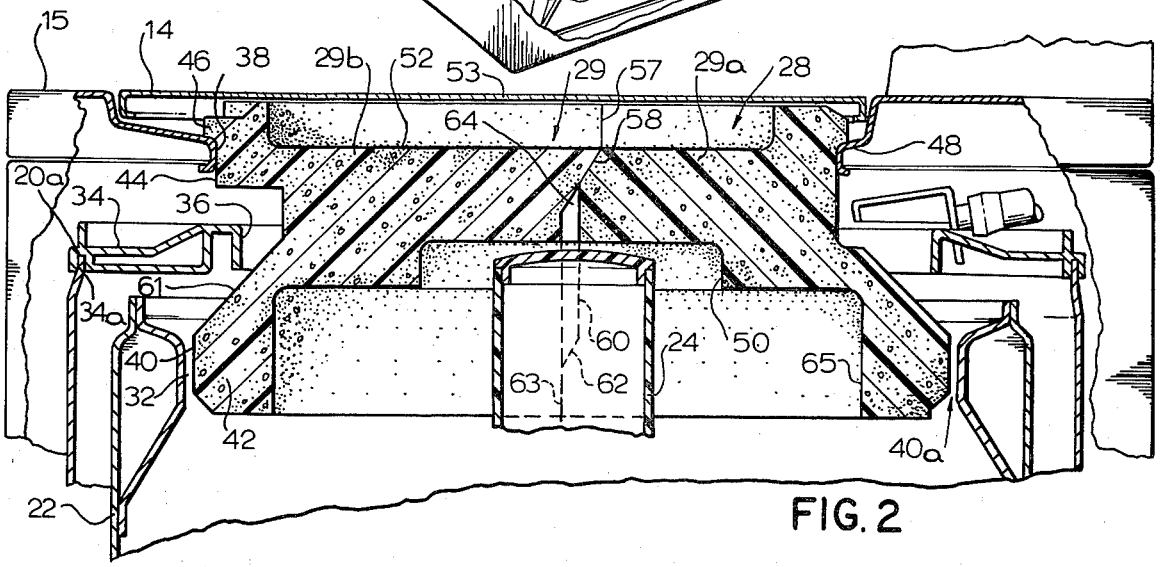
FIG. 2
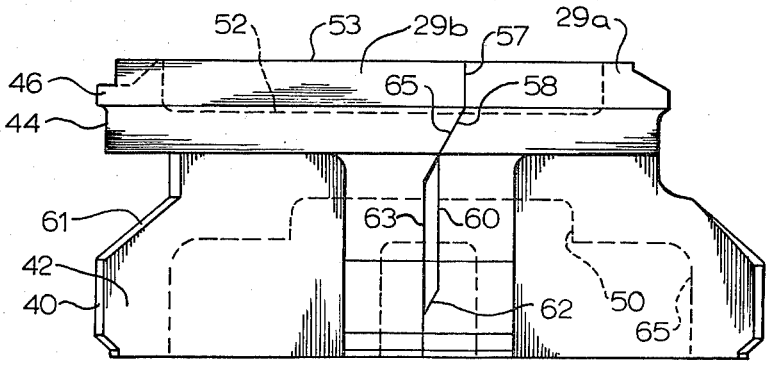
FIG. 3

FIG 4
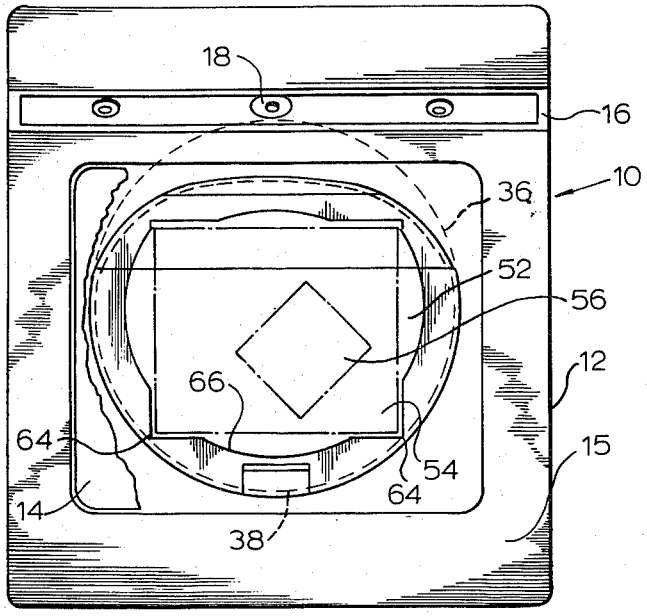
FIG 6
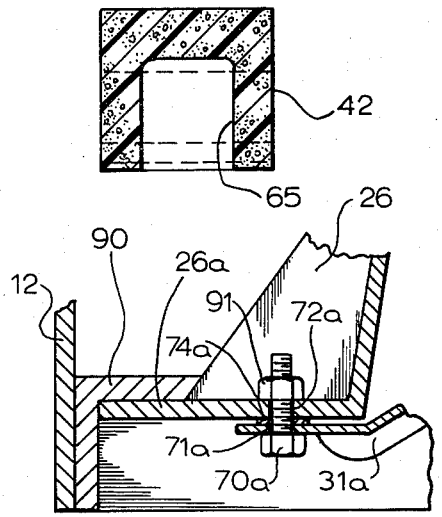
FIG 11
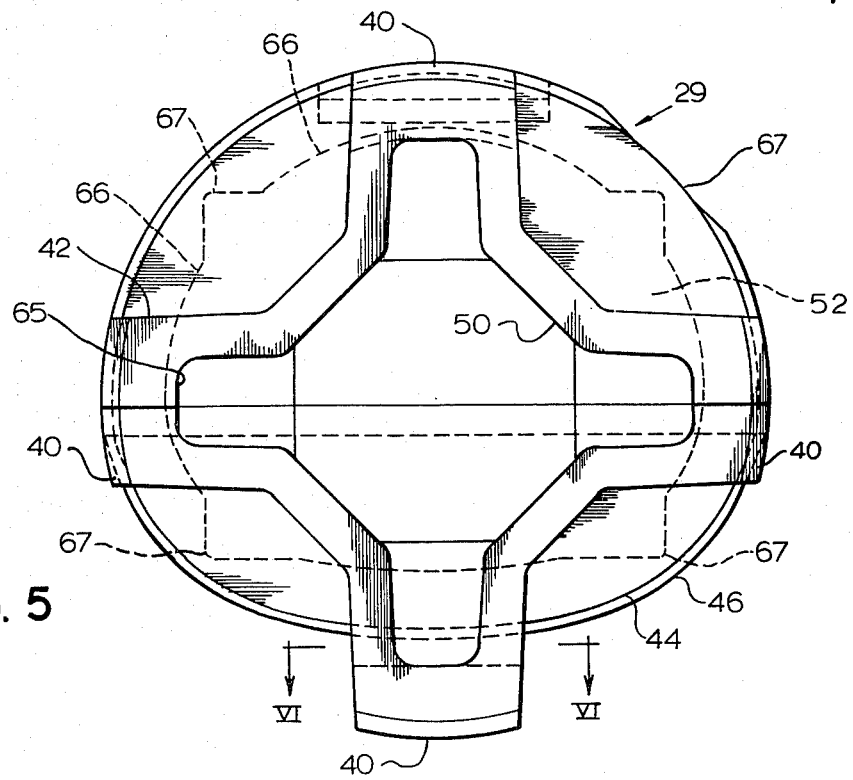
FIG. 5

FIG 7
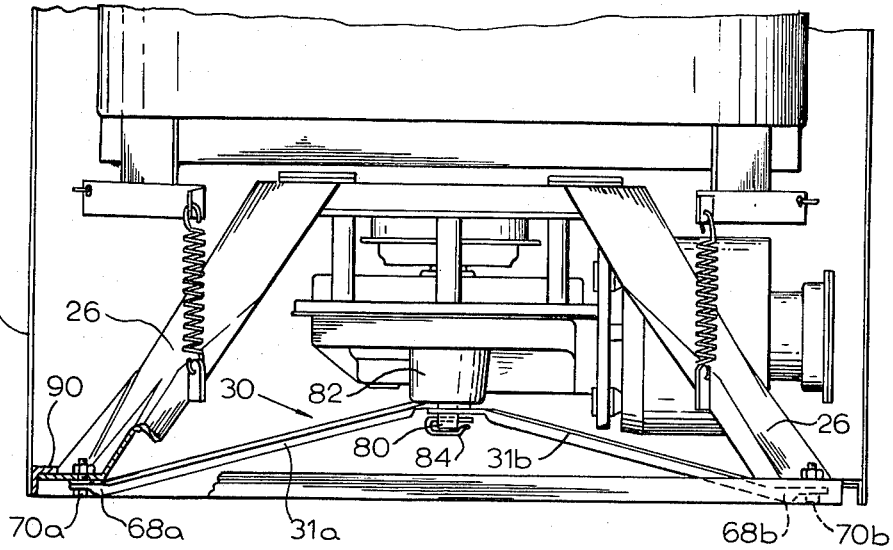
FIG 8
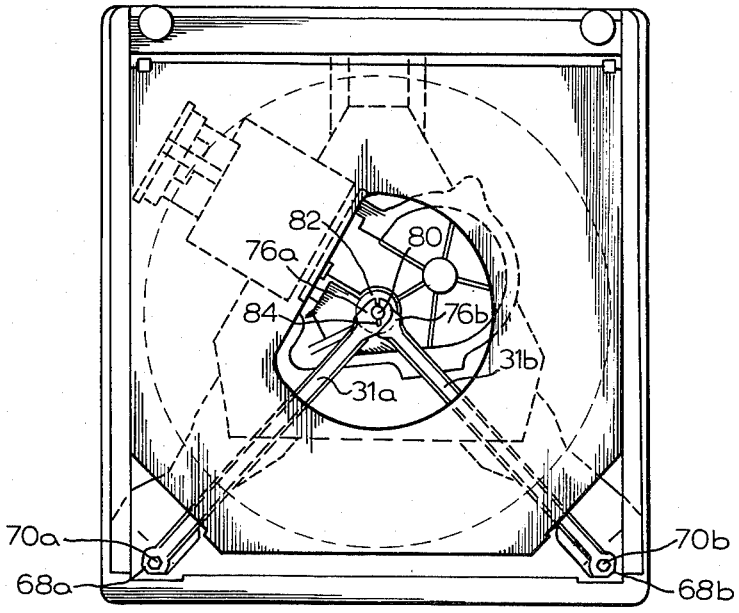
FIG 9
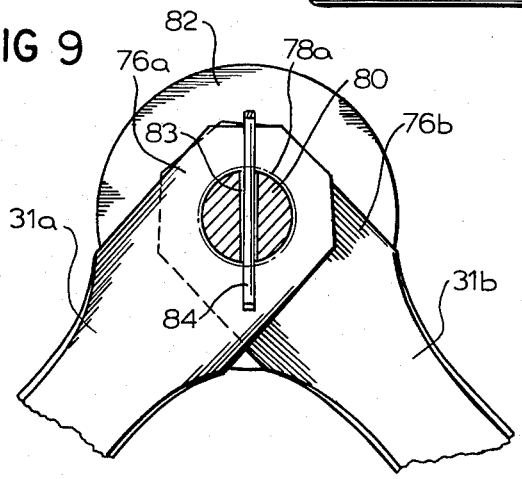
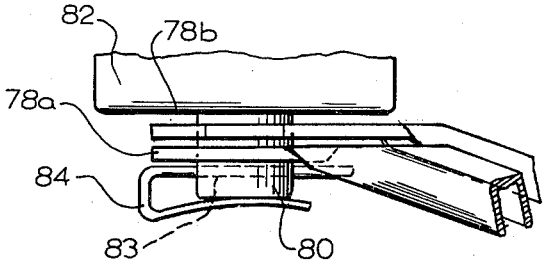
FIG 10

SHIPPING SYSTEM FOR AUTOMATIC WASHER

BACKGROUND OF THE INVENTION

1. Field of the Invention

This invention relates to a new and improved shipping system for automatic clothes washers.

2. Description of the Prior Art

There exist several types of packing devices for automatic washing machines which generally are comprised of a force transmitting member which extends between the agitator on one end and the machine housing and upper end of the clothes basket on the other end. These devices are sometimes made of resilient foam such as in U.S. Pat. No. 3,896,930 and sometimes are made of a rigid plastic material such as in U.S. Pat. No. 3,861,525. The devices disclosed in these two patents utilize a plurality of members to retain the position of the agitator and the basket constant relative to the washer housing and tub.

Some devices such as that shown in U.S. Pat. No. 3,187,887 immobilize the agitator with respect to the housing and tub with a unitary packing member.

U.S. Pat. No. 3,321,071 discloses a unitary packing member which loosely fits over the agitator and which secures the basket drum from movement relative to the housing.

SUMMARY OF THE INVENTION

In accordance with the present invention a shipping system for an automatic washer is provided which retains the movable mechanism stationary inside the washer cabinet to prevent damage during shipping and handling. The system also incorporates features that make removal of required shipping parts obvious to the consumer, so that the machine will operate properly after installation. The shipping system is comprised of two portions. The upper portion is a two-piece top shipping block which locks into place to prevent the top portion of the basket from moving excessively during shipping and which is free from contact with the agitator.

The top portion of the block contains a well area or pocket in which installation instructions and parts may be placed during shipping. Also, the top portion completely fills the opening in the top of the washer necessitating removal of the upper portion prior to use of the machine by the installer.

The lower system portion comprises two braces that are bolted one each into the front foot holes of the washer housing and are secured by a retainer at the other ends to a boss formed on the lower portion of the transmission. This lower portion secures the gear case and thus the tub and basket against movement on the suspension at its lower end.

The shipping brace comprising the lower portion of the shipping system must be removed before the front feet can be installed in the housing thus making the necessity of removal of the entire shipping system apparent to the installer.

BRIEF DESCRIPTION OF THE DRAWINGS

FIG. 1 is a perspective view of an automatic clothes washer in which a shipping system embodying the invention is installed.

FIG. 2 is a partial sectional view of the upper portion of the shipping system taken generally along the lines II—II of the FIG. 1.

FIG. 3 is a side elevational view of the two-piece shipping block forming the upper portion of the shipping system.

FIG. 4 is a top plan view of the washer of FIG. 1 partially cut away to show additional details of the shipping system of the present invention.

FIG. 5 is a bottom elevational view of the two-piece shipping block shown in FIG. 3.

FIG. 6 is a sectional view of a leg portion of the shipping block taken generally along the lines VI—VI of FIG. 5.

FIG. 7 is a side elevational view of the lower portion of the shipping system with the cabinet cut away.

FIG. 8 is a bottom plan view of the lower portion of the shipping system.

FIG. 9 is an enlarged partial view of the retaining means for the lower portion of the shipping system.

FIG. 10 is a partial side elevational view of the retaining means shown in FIG. 9.

FIG. 11 is an enlarged partial side sectional view of the bolt retaining means for the lower portion of the shipping system.

DESCRIPTION OF THE PREFERRED EMBODIMENTS

A laundry appliance 10 comprising an automatic clothes washer embodying the principles of the present invention is depicted in FIG. 1. The washer is comprised of a cabinet 12 having a top 15 with an openable lid 14 and a console 16 having presettable controls 18 thereon of the type wherein an operator may pre-select a program of automatic washing, rinsing and spinning steps in a laundering process. The lid 14 in the top 15 of the cabinet 12 permits access into the top of a tub 20 housed within the cabinet. Enclosed and supported within the tub 20 is a clothes container or spin basket 22 within which is oscillatably mounted an agitator 24.

A plurality of legs 26 (only two shown), disposed in the form of a tripod, support the washer 10 which is resiliently mounted thereon as described in Bunnell et al U.S. Pat. No. 4,174,622, owned by the assignee of the present invention and the disclosure of which is incorporated herein by reference.

In accordance with this invention a shipping system S is provided comprising an upper portion 28 consisting of a two-piece block member 29, and a lower portion 30 consisting of two rigid braces 31*a*, 31*b*. As shown in position in FIGS. 1 and 2 the shipping system S secures the floating mechanism including a drive system 33, the basket 22, the tub 20 and a tub ring 34 inside the stationary cabinet.

As best seen in FIG. 2, the basket 22 has a generally circular opening 32 formed at a top thereof. The tub 20 has an annular edge 20*a* received in a grooved recess 34*a* formed in the tub ring 34. The tub ring 34 is a generally annular member having a circular opening 36 formed therein which overlies the edge 20*a* and extends radially inwardly to overlie the interior of the tub 20 at a top end thereof. The top 15 of the cabinet 12 has an opening 38 therein below the lid 14. The basket opening 32 is larger than the tub ring opening 36 and the tub ring opening 36 is larger than the opening 38 in the top 15. A portion of the top of the agitator 24 is shown in FIG. 2. However, the configuration of the agitator and the exact position of the top portion of the agitator may vary in different models of washing machines with which the locking system S of the present invention is universally applicable. The agitator partially shown by way of exemplification is the tallest agitator which would be used with the machine shown in the drawings.

The upper portion 28 of the shipping system S consists of the two-piece block 29 having a first or rear half 29*a* and a second or front half 29*b*. As seen in FIGS. 2, 3 and 5, the exterior of the two-piece block 29 has wall portions which are shaped complementary to the openings 32 and 38 in the washer 10. Thus, curved wall portions 40, which are formed on the ends of leg members 42, are located at a position slightly interior of the basket opening 32. An annular wall portion 44 is formed near the top of the block 29 and is shaped complementary to the opening 38 in the top 15 of the washeer 10 such that it will be snugly received in the opening 38. An annular lip portion 46 is provided above the annular wall 44 to rest on a corresponding lip portion 48 formed circumferentially about opening 38 in the top 15 of the cabinet 12.

A central portion of the bottom of the block 29 is cut out or is otherwise recessed as at 50 to provide clearance for the top of the agitator 24 to prevent contact between the agitator 24 and the block 29. A second cut out or recessed portion 52 is formed in a top surface 53 of the block 29 in the shape of a tray or pocket, and as shown in FIG. 4, instruction booklets 54 and small installation parts 56 can be stored therein during shipment of the appliance 10.

To assemble the top portion 28 of the shipping system, the first half 29*a* of the block 29 is inserted into the openings 38, 36, 32 and positioned at the rear of the openings. In this manner the annular wall portion 44 abuts against the rear of opening 38 in the top 15 and the curved wall portion 40 is adjacent the rear of the basket opening 32. Angled wall portions 61 forming the tops of the legs 42 in the block 29 between the annular wall 44 and the curved wall portions 40 provide clearance for the tub ring at opening 36. A front facing wall 57 of the rear half 29*a* is beveled to form a cam ramp 58 near the top of the rear half 29*a*. A vertical wall 60 and a second cam ramp 62 below the vertical wall 60 allow the front half 29*b* of the block 29 to be inserted through the smaller top and tub ring openings 38, 36. The second half 29*b* has a substantially vertical rear wall 63 with a cam ramp 64 such that once inserted past the tub ring 34, the front half 29*b* of the block 29 cams itself outward on cam ramps 58, 62 and 64 into a locked position in opening 38 as shown in FIG. 2. A clearance 40*a* is provided between the basket 22 at opening 32 and the wall portions 40 when the block 29 is locked in place in order to insure a proper fit within manufacturing tolerances on the basket 22, the block 29 and the alignment of openings 32 and 38.

The block 29 is made of a somewhat resilient material such as expanded polystyrene, so as to absorb shocks and vibrations that cause the floating mechanism to move relative to the top 15. As shown in FIG. 2, the openable lid 14 is closed on top of the block 29 and abuts the top surface 53 thereof which retains the front and rear halves of the block 29 in the locked position. The lid 14 can be secured during shipping by means of shipping tape.

As seen in FIGS. 5 and 6, to increase the strength of the shipping block 29 while providing for a more economical utilization of materials, the shipping block radially extending legs 42 have a hollow interior 62. These legs help to absorb the vibrations during shipping and to transmit them to the top 15.

As seen in FIGS. 4 and 5, the tray recessed area 52 at the top of the block is shaped to receive the generally rectangular instruction booklet 54 and thus is provided with four corners 67 to prevent the booklet 54 from dislodging during shipping. The tray cut out 52 has arcuate wall portions 66 which provide finger access to the sides of the booklet for easy removal. The packet of small installation parts 56 such as feet for the washer is also easily stored in the tray cut out area 52.

Referring to FIGS. 7, 8, 9, 10 and 11, the lower portion 30 of the shipping system is shown to comprise the two rigid or stiff elongated braces 31*a*, 31*b* which are secured at first ends 68*a*, 68*b* to a stationary part of the machine frame. As best seen in FIGS. 7 and 11, in order to effect such fastening in accordance with this invention, fastening means 70*a*, 70*b*, such as bolts, are received in corresponding openings 71*a* in the ends 68*a*, 68*b* of the braces 31*a* and 31*b* and through threaded openings or foot holes 72*a* formed in a horizontal flange 26*a* at the end of the legs 26. The legs 26 of the tripod support are connected to an angle iron reinforcement 90 which with the legs 26 form a lower frame support or base to receive the front feet of the washer upon installation. A conventional bolt retainer 74*a*, threaded on the bolt after the bolt has been received in opening 71*a*, prevents each of the bolts 70*a*, 70*b* from being removed from the braces 31*a*, 31*b* even though a conventional nut 91 for each bolt 70*a*, 70*b* on the top side of the flange 26*a* is removed. Hence, the installer is required to remove the bolts and braces prior to installing the feet into the foot hole openings 72*a*.

Referring particularly to FIGS. 9 and 10, second ends 76*a*, 76*b* of the braces 31*a*, 31*b* have openings 78*a*, 78*b* which receive a cylindrical boss 80 formed on the bottom of a gear case 82 of the drive system 33. A cylindrical opening 83 is formed through a diameter of the boss 80 which receives a retaining means such as a spring clip 84. The retaining means or spring clip 84 secures the ends 76*a*, 76*b* of the braces 31*a*, 31*b* to the gear case 82.

Thus it is seen that a shipping system S is disclosed which retains the movable mechanism stationary inside the cabinet of the washer without using the agitator as a supporting member and which provides for a system that can be used in different machines even though there are variations in agitator configurations. The system disclosed is easy to install and the necessity of removal is clearly apparent to the consumer before operating the machine.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. For use with a washing machine of the vertical axis type having a movable mechanism enclosed within a stationary cabinet and mounted for movement on a base secured to said cabinet and having foot holes formed therein, a shipping system comprising bracing means including:

a split block upper portion which locks into position as it is installed in a top opening formed in said cabinet, said upper portion having leg members extending adjacent said movable mechanism for securing an upper end of said mechanism with respect to the stationary cabinet, and a lower portion attached to the foot holes formed in the base, said lower portion connected by a retaining means to a lower end of said movable mechanism for securing said lower end with respect to said stationary cabinet, wherein said movable mechanism includes an agitator within a washing tub, and the upper portion is formed with a generally hollow interior opening downwardly and adapted to receive the agitator without necessitating contact therewith.

2. For use with a washing machine of the vertical axis type having a movable mechanism enclosed within a stationary cabinet and mounted for movement on a base secured to said cabinet and having foot holes formed therein, a shipping system comprising bracing means including:

a split block upper portion which locks into position as it is installed in a top opening formed in said cabinet, said upper portion having leg members extending adjacent said movable mechanism for securing an upper end of said mechanism with respect to the stationary cabinet, and a lower portion attached to the foot holes formed in the base, said lower portion connected by a retaining means to a lower end of said movable mechanism for securing said lower end with respect to said stationary cabinet, wherein the top of the upper portion has a tray-like depression formed therein for receiving and storing an instruction booklet and miscellaneous small parts during shipping.

3. For use with a washing machine of the vertical axis type having a movable mechanism enclosed within a stationary cabinet and mounted for movement on a base secured to said cabinet and having foot holes formed therein, a shipping system comprising bracing means including:

a split block upper portion which locks into position as it is installed in a top opening formed in said cabinet, said upper portion having leg members extending adjacent said movable mechanism for securing an upper end of said mechanism with respect to the stationary cabinet, and a lower portion attached to the foot holes formed in the base, said lower portion connected by a retaining means to a lower end of said movable mechanism for securing said lower end with respect to said stationary cabinet, wherein the split upper portion has first and second halves with the first half having a spaced pair of cam surfaces which abut a side wall of the second half during installation to allow the second half of the upper part to be inserted through a small top and tub ring opening and to be locked into assembled position with the first half.

4. For use with a washing machine of the vertical axis type having a movable mechanism enclosed within a stationary cabinet and mounted for movement on a base secured to said cabinet and having foot holes formed therein, a shipping system comprising bracing means including:

a split block upper portion which locks into position as it is installed in a top opening formed in said cabinet, said upper portion having leg members extending adjacent said movable mechanism for securing an upper end of said mechanism with respect to the stationary cabinet, and a lower portion attached to the foot holes formed in the base, said lower portion connected by a retaining means to a lower end of said movable mechanism for securing said lower end with respect to said stationary cabinet, and further characterized by bolt means attaching said lower portion to the foot holes in the base, nut means cooperable with said bolt means and including separate bolt retainer means on said bolt means for requiring the lower portion to be removed from said base prior to installation of feet into the foot holes.

5. For use with a vertical agitator automatic washing machine having a movable mechanism including a drive system and transmission and an open basket within an open top, said movable mechanism mounted for movement on a base inside a stationary cabinet having a top forming an opening for access to said basket, a shipping system comprising:

an upper system portion including a split block closing said opening and having leg members extending interiorly of said open basket for securing an upper portion of the basket with respect to the stationary cabinet, said upper system portion being independent of said agitator, and a lower system portion including a plurality of braces extending from said transmission to said base for securing a lower portion of said basket with respect to the base.

6. A shipping system for an automatic washing machine where said washing machine has a movable mechanism including a drive system and transmission, an open basket within an open tub and a vertical agitator within said basket, said movable mechanism carried inside of a stationary cabinet having a top forming an opening for providing access to said basket, a lid closing said top opening, and a base, said washing machine further characterized by having said basket opening larger than the tub opening, said shipping system comprising:

a split two-piece block having a first half and a second half each formed with cam means for locking said first and second halves together in assembly with the adjoining basket and cabinet top to retain the basket relatively stationary with respect to said stationary cabinet.

7. A shipping system as defined in claim 6 and further characterized by said cam means comprising:

a spaced pair of cam surfaces on a side wall of said first half for mating with a side wall of said second half, said second half side wall having a single cam surface such that said second half of said upper portion can be inserted through the top and tub openings to be positioned adjacent to said basket opening.

8. A shipping system as defined in claim 6 including:

a lower system portion comprising a pair of braces, retaining means at one end of each brace for connecting the brace to the transmission of the washing machine, and connecting means at an opposite end of each brace for connecting said brace to a foot hole formed in said base, whereby the movable mechanism is secured against excessive movement during shipping.

9. A shipping system as defined in claim 8 wherein said connecting means comprises a bolt and nut and a retainer for each said brace, said retainer being connected to said brace and having an opening through which said bolt passes in a threaded relation for locking said bolt to said brace so that the brace is required to be removed prior to installation of feet into the corresponding foot holes.

10. A shipping system as defined in claim 9, wherein said block is made of a resilient material.

* * * * *